United States Patent [19]

Freermann

[11] Patent Number: 5,018,416

[45] Date of Patent: May 28, 1991

[54] METHOD OF AND APPARATUS FOR CUTTING PIECES FROM AN ELONGATED TEXTILE WEB

[75] Inventor: Johannes Freermann, Ochtrup, Fed. Rep. of Germany

[73] Assignee: Carl Schmale GmbH & Co. KG, Ochtrup, Fed. Rep. of Germany

[21] Appl. No.: 392,053

[22] Filed: Aug. 10, 1989

Related U.S. Application Data

[63] Continuation-in-part of Ser. No. 174,074, Mar. 28, 1988, abandoned.

[30] Foreign Application Priority Data

Mar. 27, 1987 [DE] Fed. Rep. of Germany ..... 3710025

[51] Int. Cl.[5] ..... D05B 1/00; D05B 27/00

[52] U.S. Cl. ..... 83/14; 83/78; 83/109; 112/262.3; 112/121.15; 112/304; 198/512; 198/376; 271/10; 271/264

[58] Field of Search ..... 83/13, 14, 23, 78, 109; 112/10, 141, 2, 153, 121.15, 262.1, 304, 262.3, 262.2, 121.11, 121.12, 303; 198/512, 376; 271/10, 13, 264

[56] References Cited

U.S. PATENT DOCUMENTS

| | | | |
|---|---|---|---|
| 2,546,527 | 3/1951 | Smyth | 112/304 |
| 3,008,436 | 11/1961 | Golden . | |
| 3,208,418 | 9/1965 | Frydryh | 112/304 |
| 3,375,796 | 4/1968 | Greenberg et al. . | |
| 3,467,037 | 9/1969 | Frydryk | 112/121.15 |
| 4,432,295 | 2/1984 | Rasin et al. | 112/262.3 |
| 4,483,266 | 11/1984 | Olasz etal. | 112/121.11 X |
| 4,499,834 | 2/1985 | Ruetschle et al. | 112/121.11 X |
| 4,693,460 | 9/1987 | Adamson et al. | 271/10 |
| 4,750,442 | 6/1988 | Keeton . | |
| 4,756,262 | 7/1988 | Wilson | 112/304 |
| 4,773,341 | 9/1988 | Brocklehurst . | |
| 4,821,656 | 4/1989 | Dordi et al. | 112/304 X |

*Primary Examiner*—Timothy V. Eley

*Attorney, Agent, or Firm*—Herbert Dubno; Andrew Wilford

[57] ABSTRACT

A leading edge of a web is fed to an upstream cutting station and is gripped at the cutting station with an upstream clamp which is then advanced downstream away from the cutting station to a middle station and is arrested in the middle station where the leading edge of the web is gripped with a downstream clamp and released from the upstream clamp. The leading edge held by the downstream clamp is then moved downstream to a holding station and the opened upstream clamp is moved along the web to a position slightly upstream of the upstream cutting station. The web is then gripped immediately downstream of the upstream cutting station with an upstream clamping conveyor and immediately upstream of the downstream holding station with a downstream clamping conveyor, and is gripped immediately upstream of the upstream cutting station with the upstream clamp. Finally the web is cut between the upstream clamp and the upstream clamping conveyor so as to cut the leading end off the web, leaving the cut-off end spanned between the upstream clamping conveyor and downstream clamping conveyor and forming a new leading edge of the web at the cutting station. The cut-off piece is conveyed away from the stations with the clamping conveyors.

9 Claims, 8 Drawing Sheets

D
O
M
1
2
3
4
5
7
8
9
10
11
12
31
39
40
41
42
43
44
45
46
47
48
49

D
VI
VI
4
5

FIG.4K
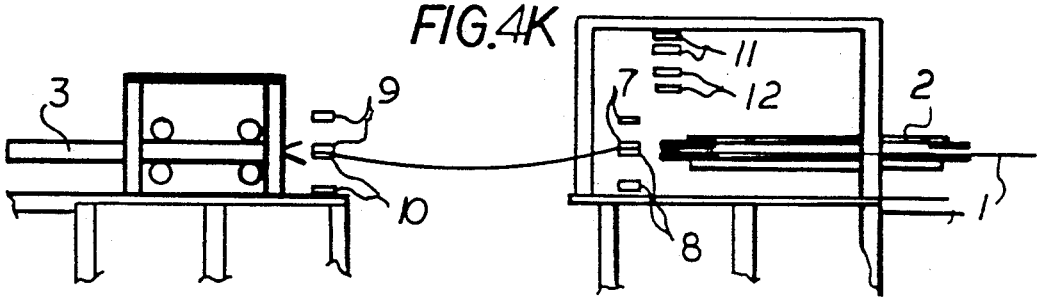
FIG.5K
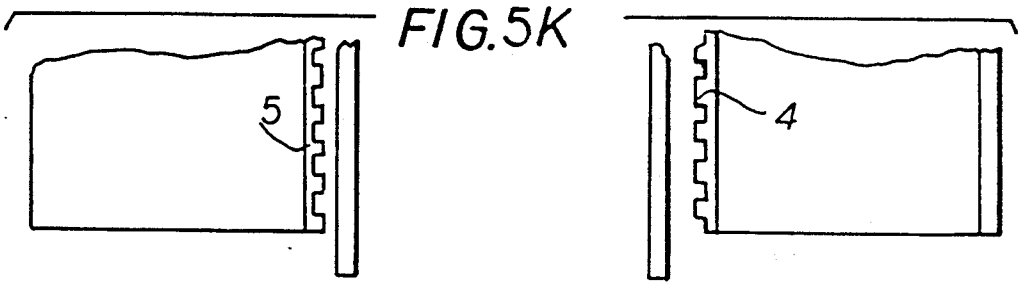
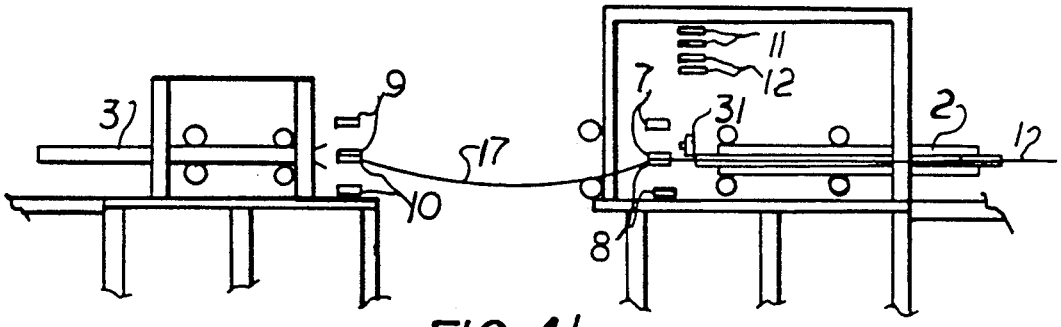
FIG.4L
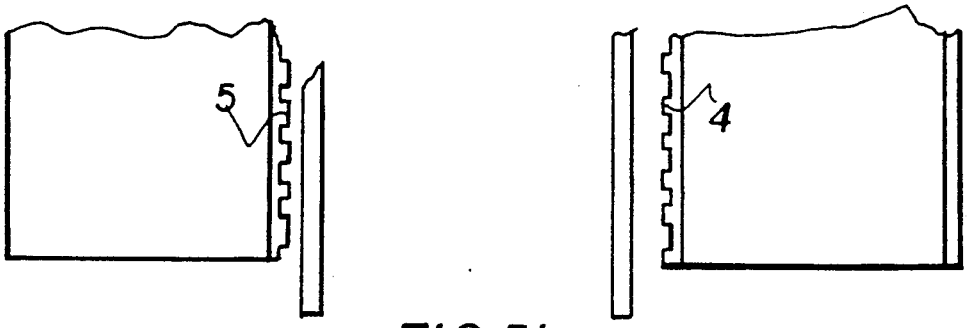
FIG.5L

METHOD OF AND APPARATUS FOR CUTTING PIECES FROM AN ELONGATED TEXTILE WEB

CROSS-REFERENCE TO RELATED APPLICATIONS

This application is related to patent applications 07/174,073 (now U.S. Pat. No. 4,834,232), 07/174,117 (now abandoned), and 07/210,149 (now U.S. Pat. No. 210,479) and is a continuation-in-part of application Ser. No. 07/174,074 (now abandoned).

FIELD OF THE INVENTION

The present invention relates to method of and apparatus for cutting pieces from an elongated textile web. More particularly this invention concerns the subdivision of a length of selvedged goods for the formation of towels or the like.

BACKGROUND OF THE INVENTION

It is possible to make a textile product hemmed on all its edges completely automatically by cutting and transversely conveying a continuous textile web hemmed on its longitudinal edges and wound on or stored in a goods or fabric roll on a beam and feeding the cut pieces for further working such as hemming on the cut edges by sewing machines. The quality requirements for certain special textile products have greatly increased of late so that the manufacturing processes used up to now have often been unsatisfactory.

Furthermore large numbers of pieces of these products must be made according by economical methods of manufacture in a completely automatic process in many cases. This is for instance the case in the mass production of hand or dish towels. The apparatus for performing this process must be very long because of the large width of the goods and/or because several textile fabric webs are processed side-by-side.

According to the known process a textile web drawn from a web-carrying beam on which the roll of the web is coiled is fed transversely to a longitudinal conveyor and cut to form the desired pieces. The textile web can have reinforced or selvedged edges on its long sides, e.g. a woven edge, a seam or border, a glued edge or a stitched or knitted or selvage seam according to requirements. After cutting, hemming operations must be performed on both cut sides in the new longitudinal feed direction.

The process known up to now and the machines for performing it often do not operate satisfactorily, especially at high speed and in completely automatic operation. They have a high degree of waste and are unreliable.

OBJECTS OF THE INVENTION

It is therefore an object of the present invention to provide an improved method of and apparatus for cutting pieces of an elongated textile web.

Another object is the provision of such an improved method of and apparatus for cutting pieces of an elongated textile web which overcomes the above-given disadvantages, that is which operates wholly automatically and rapidly and the produces workpieces of exact dimensions.

SUMMARY OF THE INVENTION

The method of cutting pieces from an elongated flexible web and delivering the pieces to a treatment machine according to this invention comprises the step of first feeding a leading edge of the web downstream in an upstream-to-downstream direction to an upstream cutting station with the edge extending transversely of the direction and gripping the leading edge at the cutting station with an upstream clamp. This upstream clamp is then advanced downstream away from the cutting station to a middle station spaced downstream from the cutting station and is arrested in the middle station where the leading edge of the web is gripped with a downstream clamp and then released from the upstream clamp. The downstream clamp and the leading edge held thereby are then moved downstream to a downstream holding station and generally simultaneously the opened upstream clamp is moved along the web upstream to a position slightly upstream of the upstream cutting station, so that a piece constituting a leading end of the web is left extending between the upstream cutting station and the downstream clamp in the downstream holding station. The web is then gripped immediately downstream of the upstream cutting station with a transversely effective upstream clamping conveyor, is gripped immediately upstream of the downstream holding station with a transversely effective downstream clamping conveyor, and is gripped immediately upstream of the upstream cutting station with the upstream clamp. Finally the web is cut longitudinally between the upstream clamp and the upstream clamping conveyor so as to cut the leading-end piece off the web, leaving the cut-off piece spanned between a trailing edge at the upstream clamping conveyor and a leading edge at the downstream clamping conveyor and forming a new leading edge of the web at the cutting station. The cut-off piece is conveyed off transversely to the direction and generally parallel to its leading and trailing edges away from the stations with the clamping conveyors.

With this system, therefore, the web is automatically cut into pieces and then is conveyed off in a direction parallel to its freshly cut edges. This makes it very easy to work on these edges, or instance selvedge them or sew seam-binding tape to them. The whole procedure works automatically and it is even possible according to this invention to simultaneously advance, clamp, cut, and convey a plurality of parallel such webs.

According to another feature of this invention the clamping conveyors each have an upper member and a lower member at least one of which is vertically displaceable toward and away from the other. These members are displaced vertically apart to open the respective clamps when they are moved transversely between their respective stations.

During the first portions of each of the steps in which the clamps grossly move the web these are moved relatively rapidly and during the terminal portions of each of these steps they are moved substantially more slowly. This creeping action in the terminal stages ensures very accurate positioning of the web piece while the fast movement at the starting stages keeps the machine operating rapidly.

In addition according to this invention before the web is gripped by the downstream clamp conveyor the downstream clamp is moved slightly upstream to slacken the piece. In this manner the piece is not too tight and will not pull out of the clamp conveyors.

The upstream and downstream clamps of the apparatus according to this invention have confronting downstream and upstream edges that are toothed and interfit. Thus they can overlap the middle station a little and securely grab and pass off the web. The clamping conveyors are formed by respective pairs of upper and lower belts having lower and upper stretches that can be moved vertically to grip the workpiece.

DESCRIPTION OF THE DRAWING

The above and other objects, features, and advantages will become more readily apparent from the following, reference being made to the accompanying drawing in which:

FIGS. 4A through 4L are small-scale views like FIG. 2 showing the apparatus in different positions of its operating cycle;

FIGS. 5A through 5L are small-scale top views like FIG. 3 and corresponding to respective FIGS. 4A through 4L;

SPECIFIC DESCRIPTION

Figure 1:
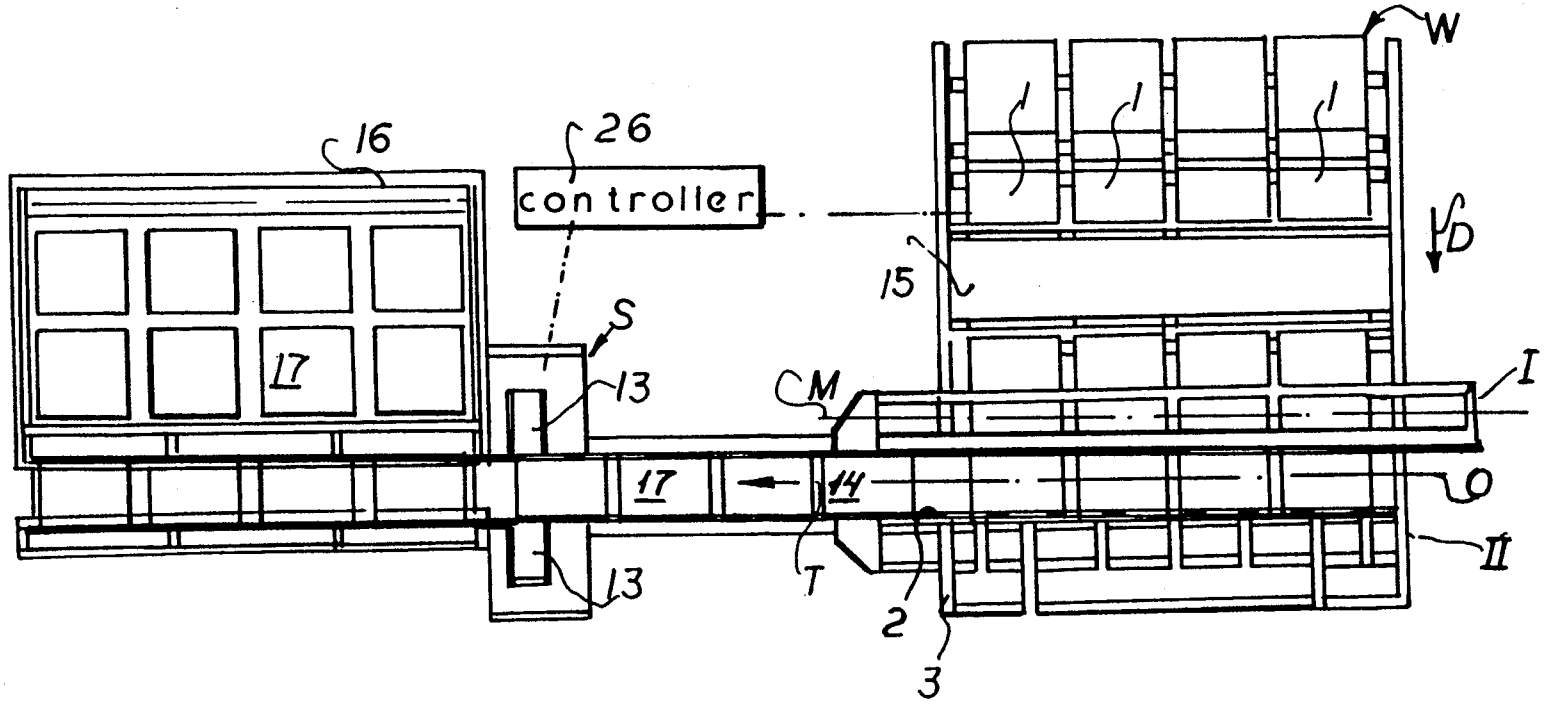
FIG. 1 is a small-scale top view of the entire apparatus for making the hemmed product according to this invention.
Figure 2:
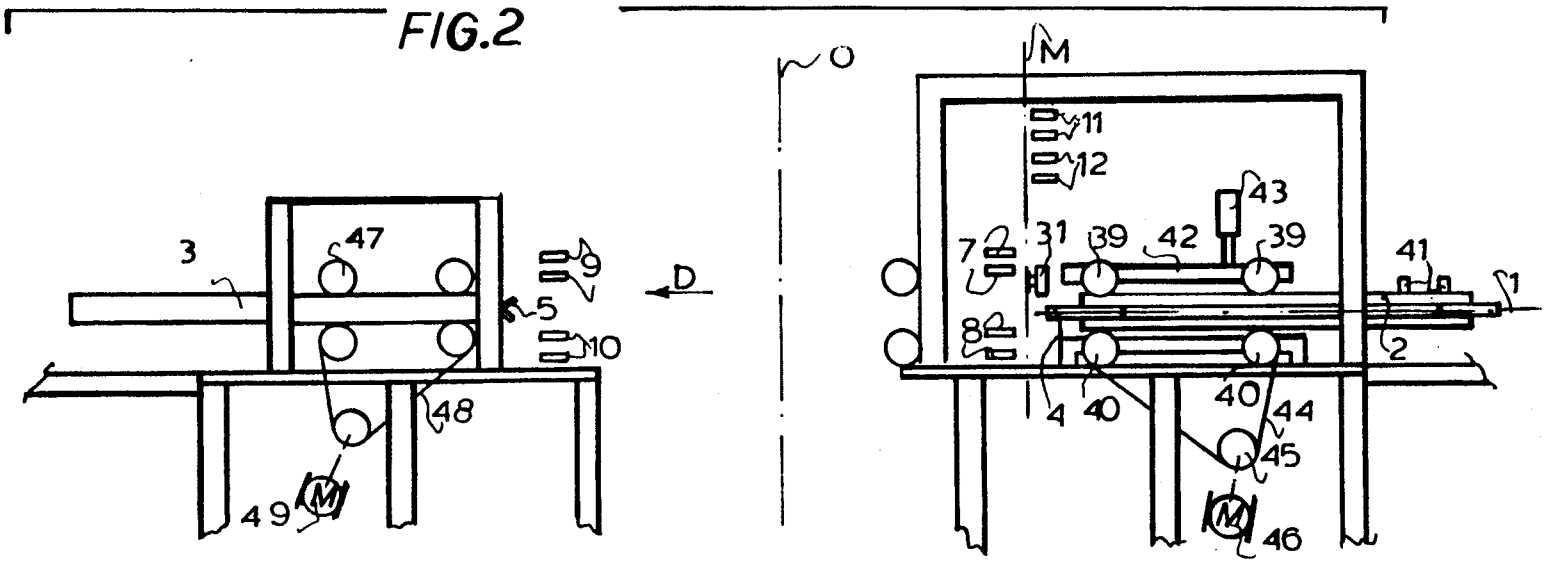
FIG. 2 is a diagrammatic side cross sectional view of a portion of the apparatus.
Figure 3:
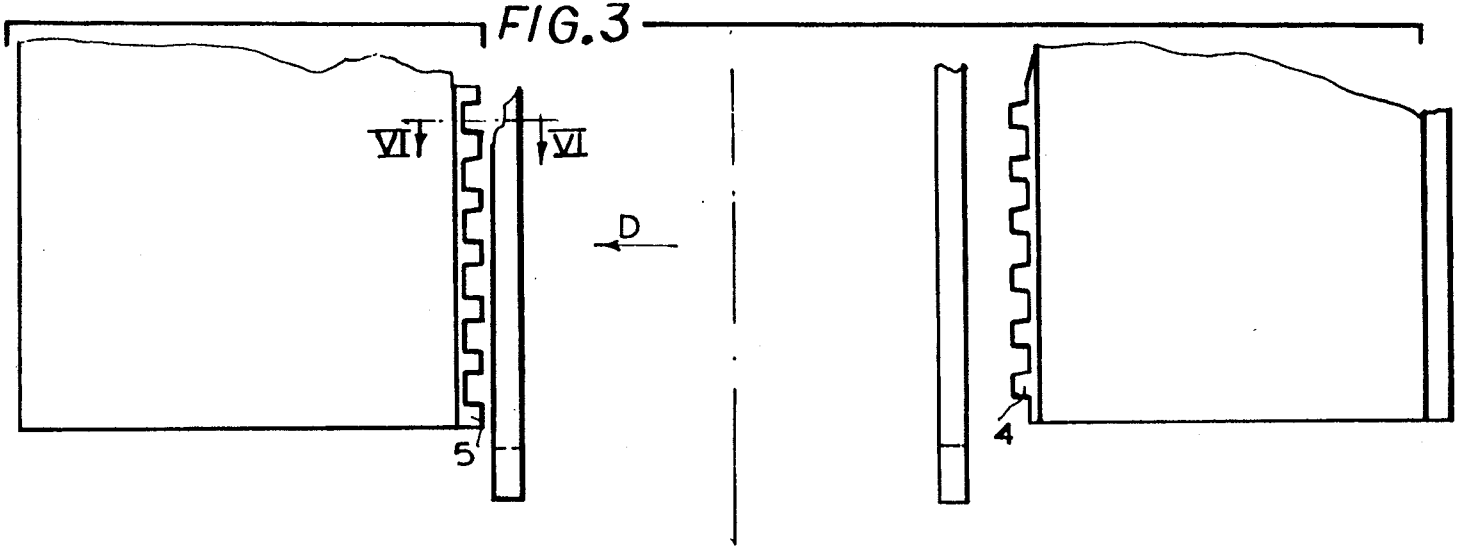
FIG. 3 is a diagrammatic top plan view of the clamps and the belts of the apparatus shown in FIG. 1.

As seen in FIGS. 1, 2, and 3 the apparatus according to my invention comprises two apparatus halves I and II which can travel toward and away from each other in and against an upstream-to-downstream transport direction D between positions set according to the width of the goods in a direction T transverse to the direction D. The textile web 1 runs downstream (downward from the upper right in FIG. 1) from a web-carrying beam W through an upstream feed clamp 2 which is movable in the right-hand or upstream portion I of the apparatus I, II and which is shown in FIG. 2 in the closed position. An upper clamping conveyor belt 7 and a lower clamping conveyor belt 8 are provided in the upstream machine half I movable between the position in FIG. 2 in which the clamp 2 can move between them to a position with the lower stretch of the upper belt 7 engaging downward on the upper stretch of the lower belt 8.

Figure 7:
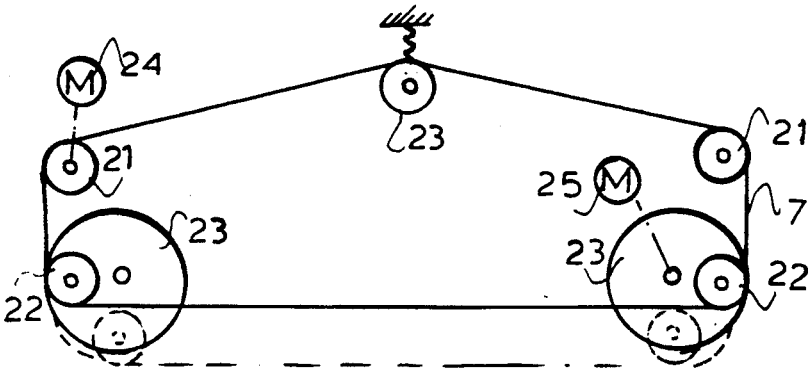
FIG. 7 is a largely diagrammatic side view illustrating part of one of the conveyor-belt systems of this invention.

To this end as shown in FIG. 7 the upper belt 7 is spanned between two upper rollers 21 and two lower rollers 22. A tensioning roller 23 is provided between the upper rollers 21 and the lower rollers 22 are carried offcenter on wheels 24. Drives 24 can rotate the rollers 21 to advance the belt 7 and drives 25 can oscillate the wheels 23 to vertically displace the lower stretch of the belt 7. Thus the lower rollers 22 can be moved up and down to move the lower stretch of the belt 7 similarly up and down. The drives 24 and 25 are operated by a controller shown schematically at 26 in FIG. 1. The belt 8 is similarly mounted and controlled, but of course its upper stretch is the one that is vertically displaceable.

The downstream apparatus half II has a pull clamp 3 also movable on its side of a middle line 0 of the machine in the direction D. Two more clamping-conveyor belts 9 and 10 are provided in the downstream machine half II and are operable like the belts 7 and 8 to allow the clamp 3 to pass between them. The belts 9 and 10 are mounted and controlled like the belts 7 and 8 and are in fact operated perfectly synchronously therewith.

Figure 6:
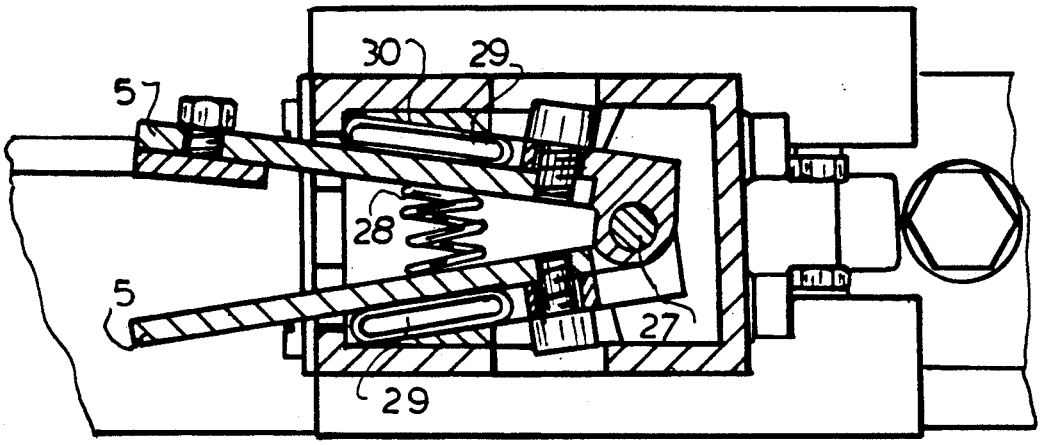
FIG. 6 is a cross section through the downstream gripper, taken generally along line VI—VI of FIG. 2.

As seen in FIG. 6 the pull clamp 3 has upper and lower toothed jaws 5 that are pivoted together at 27 and pushed apart into the illustrated open position by springs 28. Inflatable elongated bladders 29 are braced between each of the jaws 5 and a part of the respective housing half 30. The controller 26 incorporates a source of gas under pressure and can inflate these bags 29 when necessary to close the jaws 5 together. As seen in FIG. 3 the downstream edge of the upstream clamp 2 is similarly toothed at 4 and can interdigitate with the jaws 5.

FIG. 2 illustrates how the upstream clamp 2 is gripped between upper rollers 39 and lower rollers 40. This clamp 2 is provided with unillustrated springs that urge its upper and lower parts apart, that is into an open position, and these upper and lower halves are locked together against relative horizontal movement by pins 41 that are to the side out of the path of the goods 1. The upper rollers 39 are carried on a support 42 vertically displaceable by a pneumatic cylinder 43 or the like that is operated by the controller 26 for opening and closing this clamp 2. The lower rollers 40 are vertically nondisplaceable, but are both engaged by a belt 44 engaged over a drive pulley 45 in turn operated by a motor 46 itself started and stopped by the controller 26. The pull clamp 3 is similarly carried on rollers 47 driven by a belt 48 from a motor 49 also operated by the controller 26.

Figure 8:
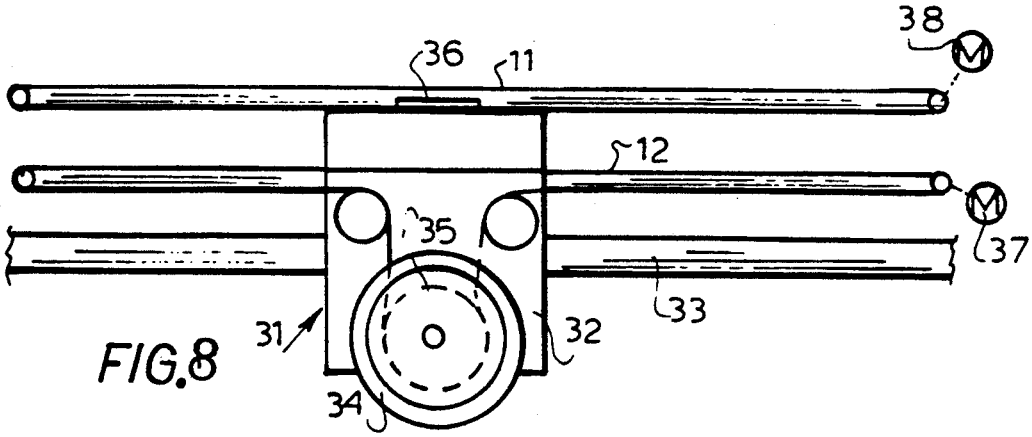
FIG. 8 is a largely diagrammatic side view of the cutter.

The upstream machine half I is further provided with a belt 11 capable of moving a cutter 31 in a cutting plane M and a belt 12 is provided to rotate this cutter C. As seen in FIG. 8 the cutter 31 has a housing 32 slidable across the goods 1 on a rail 33 extending perpendicular to the direction D. This cutter 31 has a disk blade 34 that lies in the plane M and is carried on a pulley 35 around which the belt 12 is spanned, and the belt 11 is clipped at 36 to the top of the housing 32. Direct-current motors 37 and 38 like the motors 24 and 25 are connected to and operated by the controller 26. The entire cutter 31 can move completely across the goods 1 and can sit in either of two end positions completely out of the path of the goods 1 so that it need not be returned after a cutting operation as described below. The plane M lies between the clamp 2 in its furthest upstream position illustrated in FIG. 2 and 3 and the clamp belts 7 and 8 which cannot move in the direction D.

The apparatus described above operates as follows, as illustrated in detail in FIGS. 2 and 3 and 4A, 5A through 4L, 5L:

To start with as shown in FIGS. 2 and 3 the clamp 2 is closed in its extreme upstream position on a web 1 having a leading edge normally formed by a preceding cut and extending about 1 cm from the downstream edge of the jaws 4 at least to the plane M, and the clamp 3 is open and in its furthest downstream position. The upstream clamp belts 7 and 8 and the downstream clamp belts 9 and 10 are in their open, that is vertically spaced, positions.

Figure 4A:
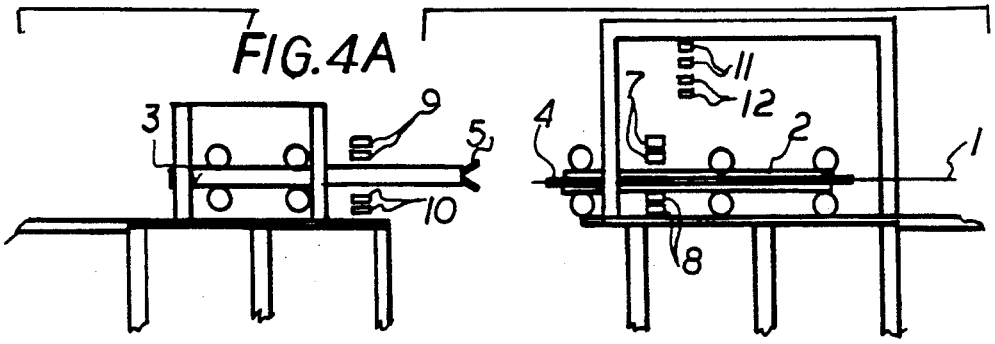
Figure 5A:
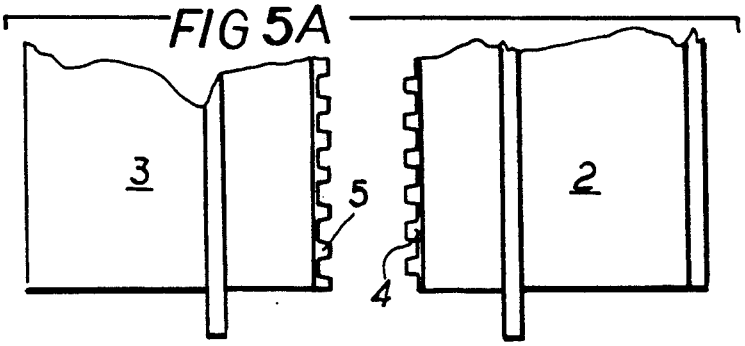

Then as shown in FIGS. 4A and 5A the motor 46 is energized and the closed feed clamp 2 travels with the clamped textile web 1 rapidly downstream until its leading edge is just short of the center midline 0 between both apparatus halves I, II and similarly the motor 49 moves the downstream pull clamp 3 rapidly upstream to a position just short of the centerline 0.

Figure 4B:
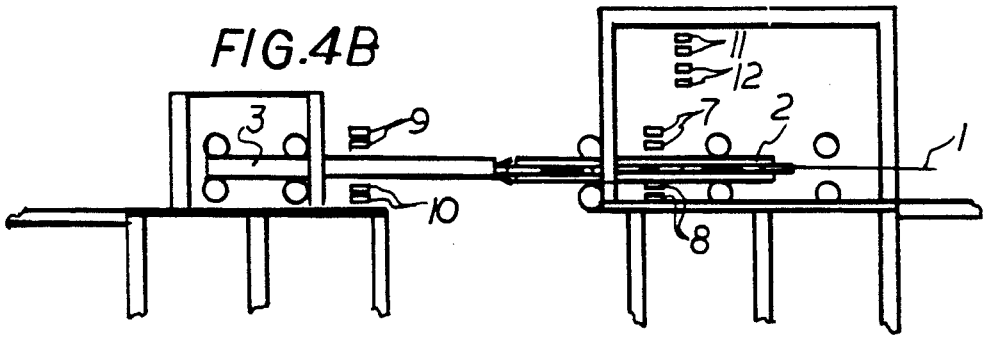
Figure 5B:
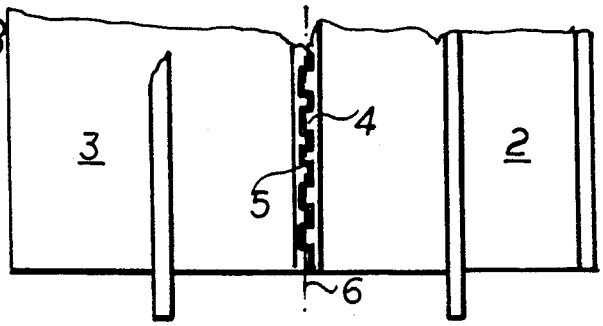

Then the clamp 2 is slowed considerably until it is moved exactly to the center 0. At the same time the open pulling clamp 3 of the downstream (left in the drawing) apparatus half II similarly creeps until its open upstream jaw or edge 5 interdigitates with the closed downstream edge or jaw 4 of the feed clamp 2 at the center 0 as shown in FIGS. 4B and 5B.

Figure 4C:
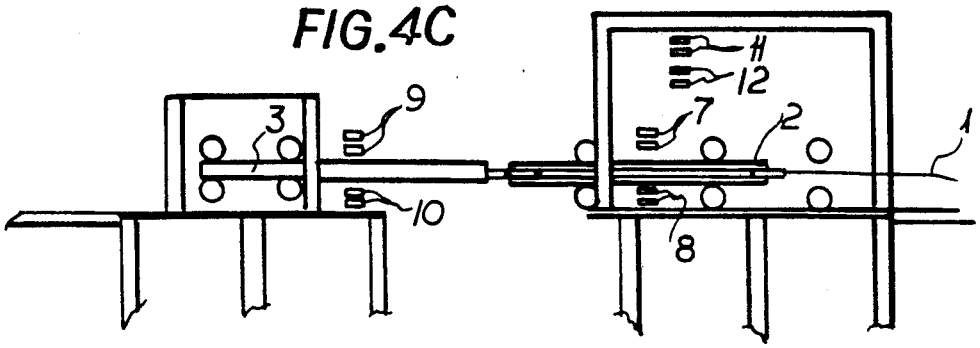
Figure 5F:
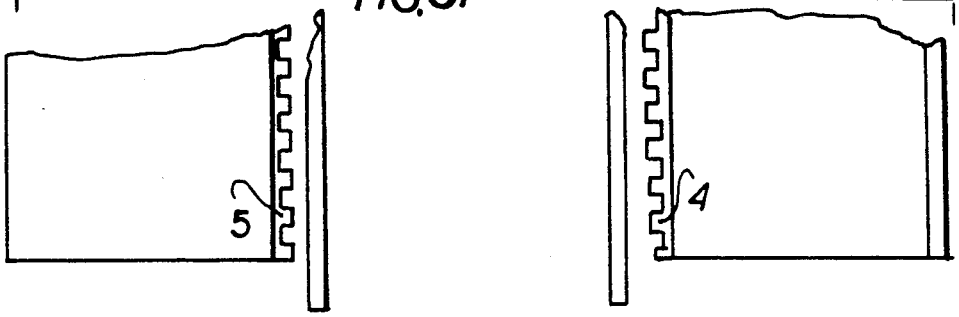
Figure 5G:
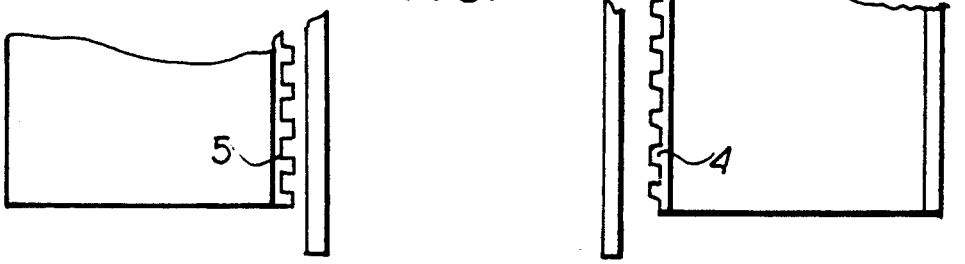
Figure 5C:
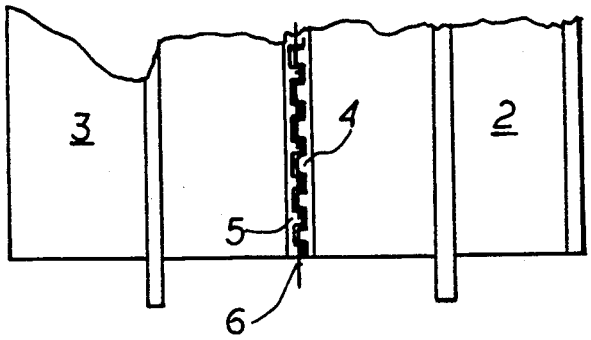

Then as shown in FIGS. 4C and 5C the pulling clamp 3 is closed by pressurization of the bladder 29 so that both clamps 2 and 3 are closed and the leading edge of the goods 1 is effectively held by both of them.

Figure 4F:
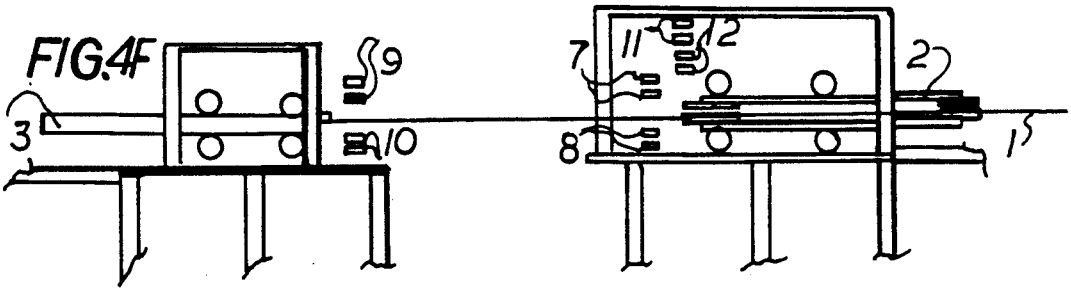
Figure 4G:
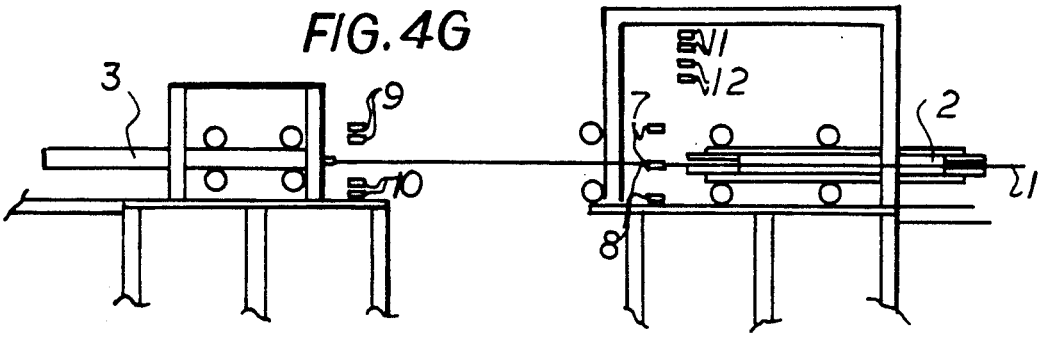
Figure 4H:
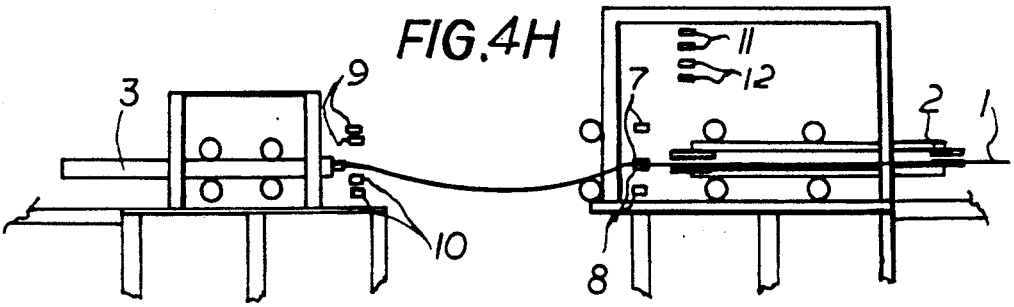
Figure 4D:
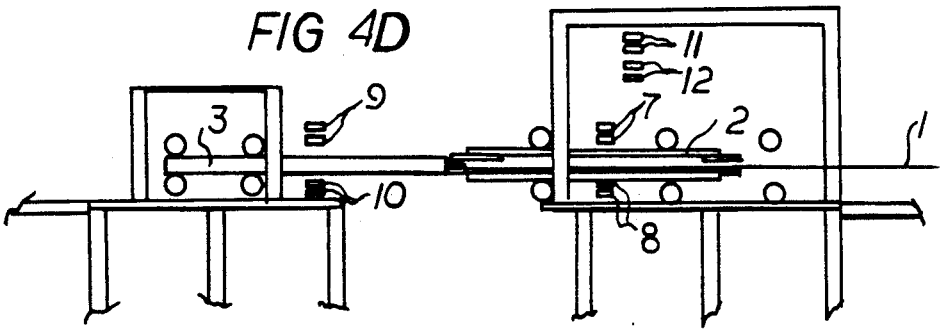
Figure 5D:
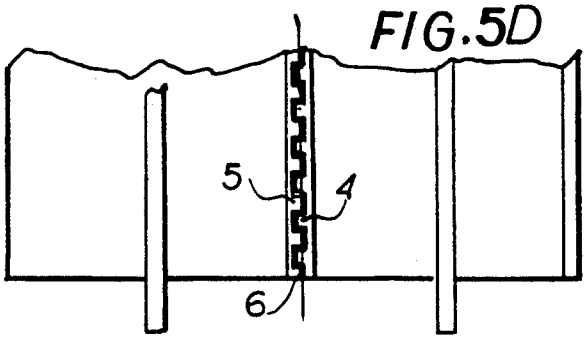
Figure 4E:
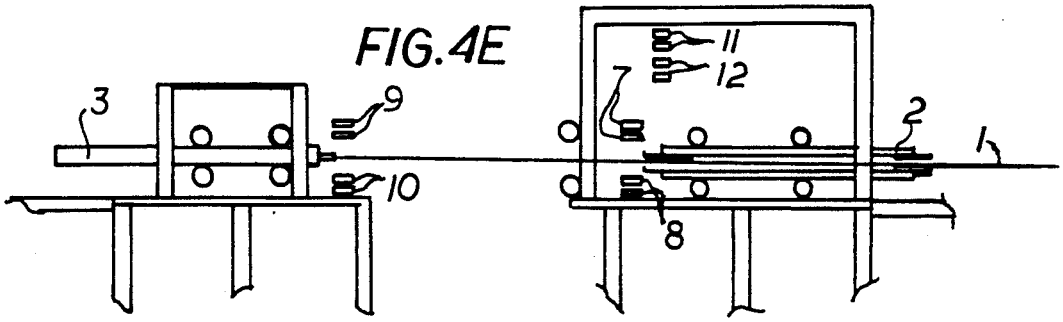
Figure 5E:
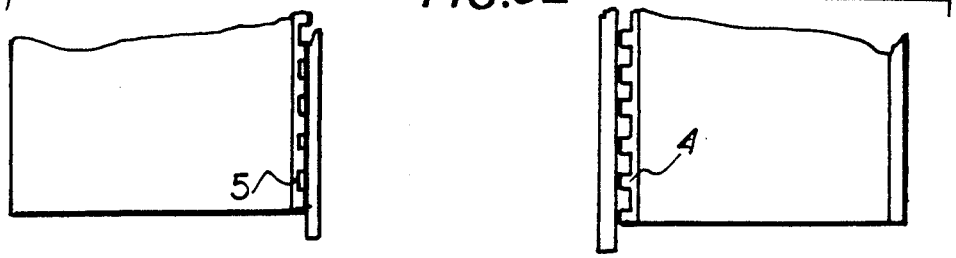

The feed clamp 2 then opens by operation of the actuator 43 as shown in FIGS. 4D and 5D and both clamps 2 and 3 travel rapidly away from each other (FIGS. 4E and 5E) until shortly before they reach their final positions shown in FIGS. 4F and 5F. Movement between the positions shown in FIGS. 4E and 5E and those of FIGS. 4F and 5F takes place at low speed and once in the latter position the clamp 2 opens.

Figure 5H:
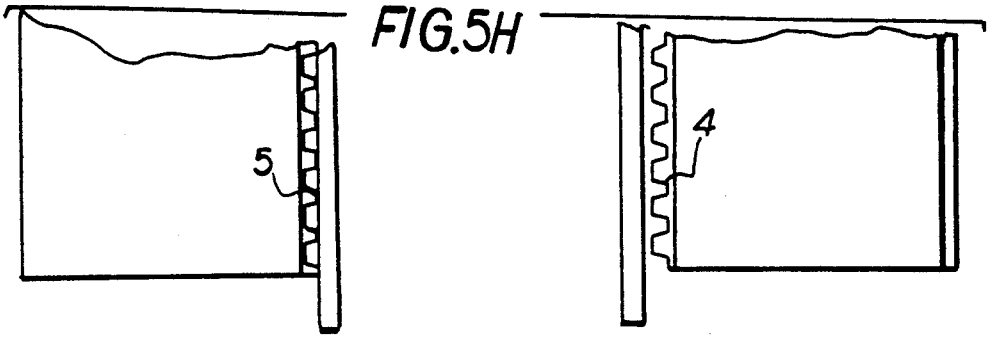

The textile web 1 is then clamped as seen in FIGS. 4G and 5G in the upstream (right-hand in the drawing) apparatus half I between the belts 7 and 8. This is achieved by pressing the lower and upper stretches of the endless belts 7 and 8 against the textile web 1 by means of the eccentric wheels 23. Then as also seen in FIGS. 4H and 5H the downstream clamp 3 moves slightly upstream to release tension in the textile web 1, so that it is gently suspended or hangs loosely between both apparatus halves I and II.

Figure 4I:
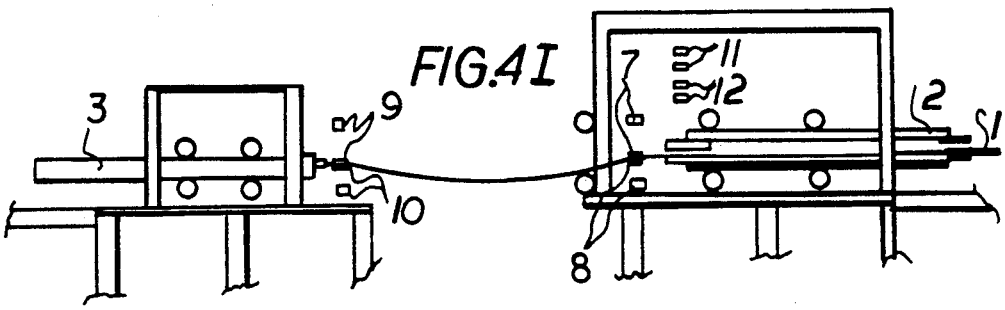
Figure 5I:
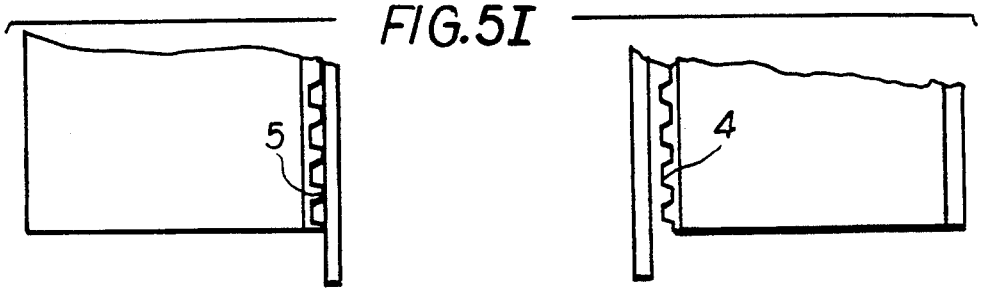
Figure 4J:
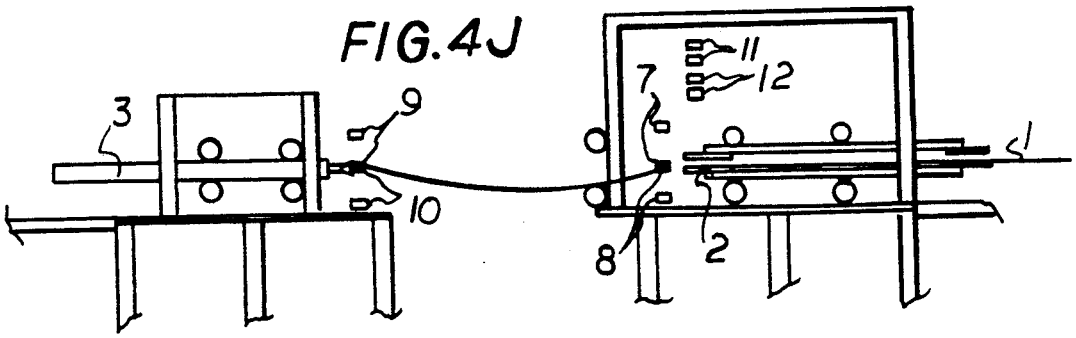
Figure 5J:
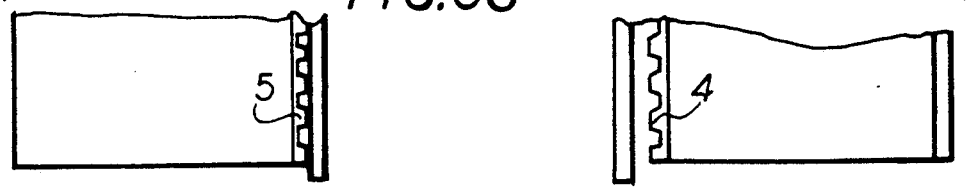

Subsequently as seen in FIGS. 4I and 5I the textile web 1 is secured or fixed in the downstream (left-hand) apparatus half II between the belts 9 and 10 in the same way as on the right side whereupon as shown in FIGS. 4J and 5J the pull clamp 3 opens and as shown in FIGS. 4K and 5K both open clamps 2 and 3 are moved somewhat further away from the center 0.

The feed clamp 2 now closes as seen in FIGS. 4L and 5L, so that it holds the web 1 somewhat taut between the upstream clamp conveyor 7, 8 and itself. Then the cutting device 31 is moved in the plane M by the belt 11 to cut a piece 17 from the leading end of the web 1, or to cut a plurality of such pieces from a plurality of such webs 1 as described below.

The thus cut piece 17 is clamped between the pair of endless belts 7 and 8 on one side and 9 and 10 on the other side and is fed in the direction T as seen in FIG. 1 to a conveyor 14 where it is moved rapidly in the direction D to a work station S provided with sewing machines 13.

When the rapid longitudinal conveyor 14 stops, both endless belt pairs 7, 8 and 9, 10 open and the initial configuration of the apparatus shown in FIGS. 4 and 5 is reached and another cycle of the process can be started.

The apparatus shown in FIG. 1 contains the web-carrying beam W on which rolls of fabric or textile material positioned side-by-side are wound up with textile webs 1 hemmed on their long side. The textile webs 1 run under an operators' platform 15 in the apparatus halves I,II provided with the feed and pulling clamps 2 and 3.

The longitudinal transport for the cut textile product 17 to the sewing machines 13 on both sides of the textile product 17 at the work station S is effected transversely to the initial feed direction from the web-carrying beam W. This transport is effected rapidly in the direction of the longitudinal arrow D. A sewing machine with up to 6000 rpm speed can provide the textile product 17 with a hem. Behind the sewing machines 13 at work station S a delivery table 16 with driven belts is used as an outfeed device where the individual pieces 17 are sorted and stacked.

I claim:

1. A method of cutting pieces from an elongated flexible web and delivering the pieces to a treatment machine, the method comprising the steps of generally sequentially:

(a) feeding a leading edge of the web downstream in an upstream-to-downstream direction to an upstream cutting station with the edge extending transversely of the direction and gripping the leading edge at the cutting station with an upstream clamp;

(b) advancing the upstream clamp and the leading edge gripped thereby downstream away from the cutting station to a middle station spaced downstream from the cutting station and stopping advance of the upstream clamp and the leading edge gripped thereby in the middle station;

(c) at the middle station gripping the leading edge of the web with a downstream clamp;

(d) releasing the leading edge from the upstream clamp;

(e) displacing the downstream clamp and the leading edge held thereby downstream to a downstream holding station and generally simultaneously displacing the upstream clamp along the web upstream to a position slightly upstream of the upstream cutting station, whereby a piece constituting a leading end of the web is left extending between the upstream cutting station and the downstream clamp in the downstream holding station;

(f) gripping the web immediately downstream of the upstream cutting station with a transversely effective upstream clamping conveyor and also gripping it immediately upstream of the downstream holding station with a transversely effective downstream clamping conveyor;

(g) gripping the web immediately upstream of the upstream cutting station with the upstream clamp while continuing to hold the web immediately downstream of the cutting station with the upstream clamping conveyor and cutting the web longitudinally between the upstream clamp and the upstream clamping conveyor so as to cut the leading-end piece off the web, whereby the cut-off piece is left spanned between a trailing edge at the upstream clamping conveyor and a leading edge at the downstream clamping conveyor and a new leading edge of the web is formed at the cutting station; and (h) conveying the cut-off piece transversely to the direction and generally parallel to its leading and trailing edges away from the stations with the clamping conveyors.

2. The method defined in claim 1 wherein the clamping conveyors each have an upper member and a lower member at least one of which is vertically displaceable toward and away from the other, the members being displaced vertically apart during steps b), c), d), and e) and the respective clamps moving transversely between their respective stations.

3. The method defined in claim 1 wherein during first portions of each of steps b) and e) the clamps are moved at a fast speed than during terminal portions of each of these steps.

4. The method defined in claim 1 wherein, before the web is gripped by the downstream clamp conveyor, the downstream clamp is moved slightly upstream to slacken the piece.

5. The method defined in claim 1, further comprising the step of:

i) stitching those edges of the cut-off piece extending parallel to its transport direction as same is being carried off in step h).

6. The method defined in claim 1 wherein the web includes a plurality of such webs from which a plurality of such pieces are simultaneously cut.

7. An apparatus for cutting pieces from an elongated flexible web and delivering the pieces to a treatment machine, the apparatus comprising:

feed means for transporting a leading edge of the web downstream in an upstream-to-downstream direction to an upstream cutting station with the edge extending transversely of the direction;

a downstream clamp displaceable between a downstream holding station downstream of the cutting station and a middle station generally midway between the upstream and downstream stations;

means including an upstream clamp displaceable between the upstream station and the middle station;

control and actuator means connected to both clamps for sequentially gripping the leading edge at the upstream station, advancing the leading edge downstream away from the cutting station to the middle station, stopping advance of the upstream clamp and the leading edge gripped thereby in the middle station, gripping the leading edge of the web at the middle station with the downstream clamp, releasing the leading edge from the upstream clamp, displacing the downstream clamp and the leading edge held thereby downstream to a downstream holding station and generally simultaneously displacing the upstream clamp along the web upstream to a position slightly upstream of the upstream cutting station, whereby a piece constituting a leading end of the web is left extending between the upstream cutting station and the downstream clamp in the downstream holding station;

a transversely effective upstream clamping conveyor immediately downstream of the upstream station and a transversely effective upstream clamping conveyor immediately upstream of the downstream station, the control and actuator means being connected to the clamping conveyors for gripping the web immediately downstream of the upstream cutting station with the upstream clamping conveyor, gripping the web immediately upstream of the downstream holding station with the downstream clamping conveyor, and gripping the web immediately upstream of the upstream cutting station with the upstream clamp while continuing to hold the web immediately downstream of the cutting station with the upstream clamping conveyor; and means including a cutter transversely movable across the web between the upstream cutting station and the upstream clamping conveyor for cutting the web longitudinally between the upstream clamp and the upstream clamping conveyor so as to cut the leading-end piece off the web, whereby the cut-off piece is left spanned between a trailing edge at the upstream clamping conveyor and a leading edge at the downstream clamping conveyor and a new leading edge of the web is formed at the cutting station, the control and actuator means further being connected to the clamping conveyors for conveying the cut-off piece transversely to the direction and generally parallel to its leading and trailing edges away from the stations with the clamping conveyors.

8. The apparatus defined in claim 7 wherein the upstream and downstream clamps respectively have toothed downstream and upstream edges that can overlap and interfit.

9. The apparatus defined in claim 7 wherein the clamping conveyors each include an upper conveyor belt having a vertically displaceable lower stretch and a lower belt having a vertically displaceable upper stretch, whereby the upper and lower stretches of each conveyor can be displaced toward each other by the actuator and control means for clamping the web.

* * * * *